United States Patent [19]

Hanson

[11] Patent Number: 4,715,771

[45] Date of Patent: Dec. 29, 1987

[54] VARIABLE GEOMETRY MOUNTING ARRANGEMENT FOR BACKHOE ASSEMBLY

[75] Inventor: Charles B. Hanson, Burlington, Iowa

[73] Assignee: J. I. Case Company, Racine, Wis.

[21] Appl. No.: 928,873

[22] Filed: Nov. 10, 1986

[51] Int. Cl.[4] ..... B66C 23/42

[52] U.S. Cl. ..... 414/688; 74/660; 414/694; 414/742

[58] Field of Search ..... 414/686, 688, 694, 742; 74/52, 98, 660

[56] References Cited

U.S. PATENT DOCUMENTS

| | | | |
|---|---|---|---|
| 3,376,984 | 4/1968 | Long et al. | 414/694 |
| 3,987,914 | 10/1976 | VanDerZyl et al. | 414/694 |
| 4,184,803 | 1/1980 | Housman | 414/694 |
| 4,212,582 | 7/1980 | Stecklein | 414/694 |
| 4,227,852 | 10/1980 | Schmitz et al. | 414/694 |
| 4,272,222 | 6/1981 | Davis | 414/694 |
| 4,304,520 | 12/1981 | Schmitz | 414/694 |

FOREIGN PATENT DOCUMENTS

| | | | |
|---|---|---|---|
| 239142 | 7/1964 | Austria | 414/694 |
| 130236 | 1/1985 | European Pat. Off. | 414/688 |
| 2012731 | 10/1971 | Fed. Rep. of Germany | 414/686 |

*Primary Examiner*—Robert J. Spar
*Assistant Examiner*—P. McCoy Smith
*Attorney, Agent, or Firm*—Dressler, Goldsmith, Shore, Sutker & Milnamow, Ltd.

[57] ABSTRACT

A variable geometry mounting arrangement for the boom assembly of a backhoe is disclosed which permits relatively great working depths without increasing the overall height of the backhoe assembly in its raised, transport position. The arrangement includes a bell-crank coupler assembly operatively interposed between a swing tower and boom assembly of a backhoe, with a gearing arrangement provided operatively connecting the boom and the swing tower. By this construction, the vertical disposition of the horizontal pivot axis of the boom is altered as the boom is pivoted. The bellcrank coupler asembly provides a central anchor for the hydraulic fluid boom actuator of the backhoe, and permits the actuator to work through a relatively large moment arm for enhanced performance, and further permits use of a relatively simpified box-section boom construction.

4 Claims, 5 Drawing Figures

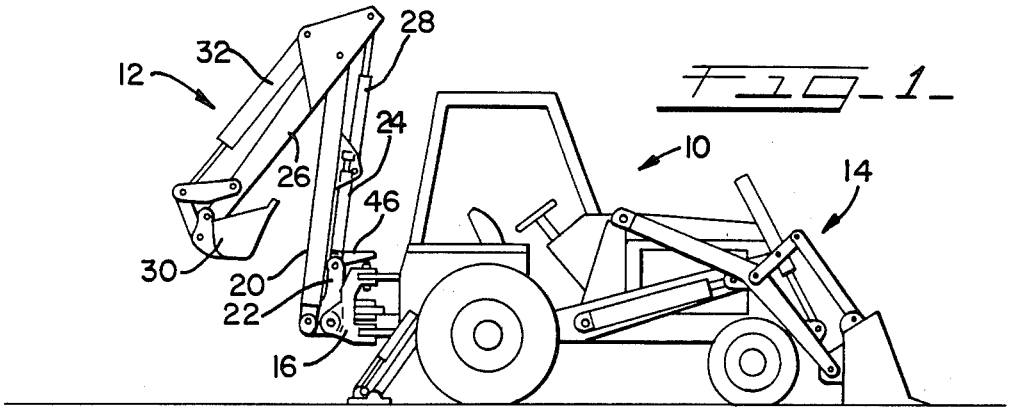
FIG. 1
FIG. 4
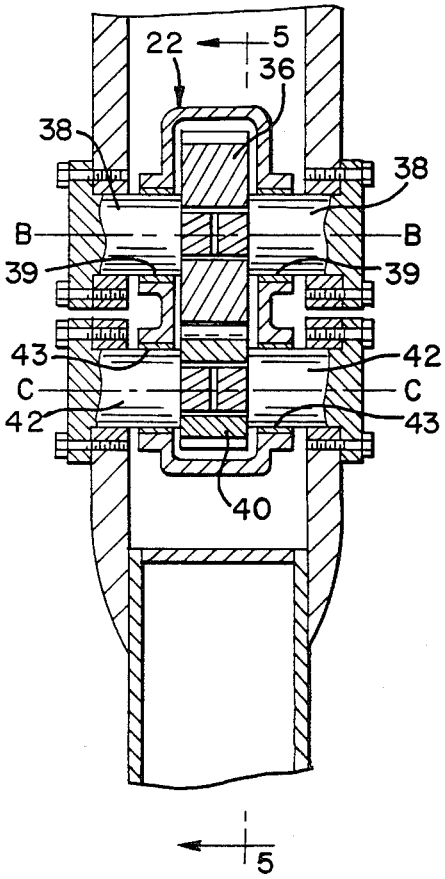
FIG. 5
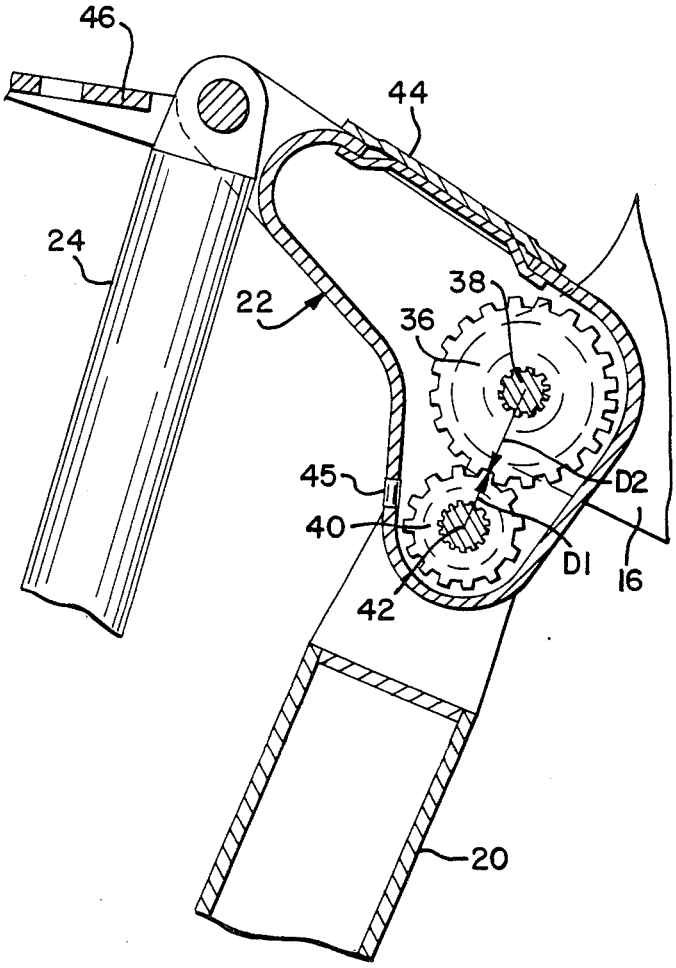

FIG. 2
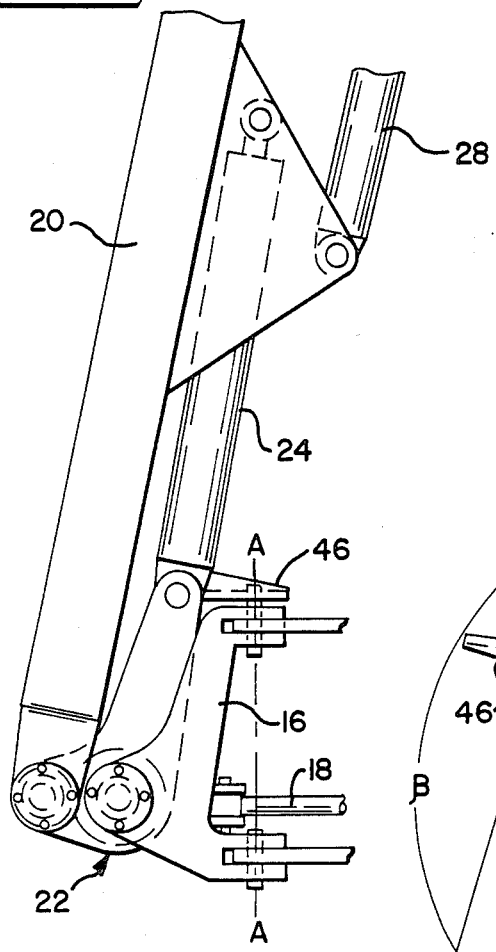
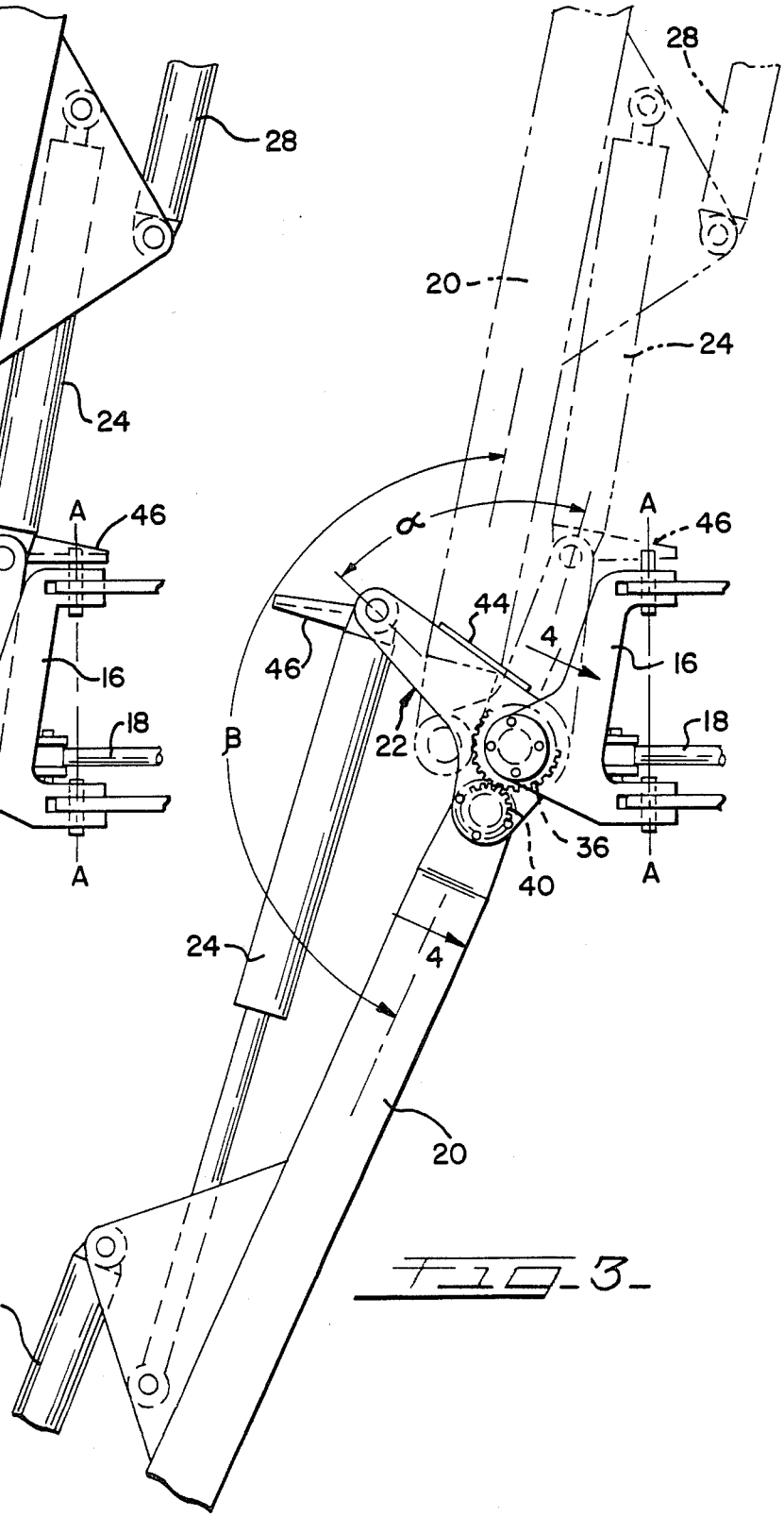
FIG. 3

VARIABLE GEOMETRY MOUNTING ARRANGEMENT FOR BACKHOE ASSEMBLY

TECHNICAL FIELD

The present invention relates generally to hydraulically-operated backhoes and like implements, and more particularly to a variable geometry backhoe boom mounting arrangement including a geared coupler mechanism.

BACKGROUND OF THE INVENTION

A hydraulically-operated backhoe is a particularly versatile piece of equipment which can be used for a wide variety of material-handling operations. A backhoe is typically mounted on the rear of a tractor or like mobile equipment, thereby providing mobility of the backhoe in use, as well as facilitating transport from one job site to another.

A backhoe includes an articulable boom and dipper arm assembly which is mounted for lateral swinging movement on an associated frame. Selectively operable hydraulic fluid actuators provide vertical pivotable movement of the boom assembly, and relative pivotal movement of the dipper arm with respect to the boom. A bucket or other tool mounted on the free end of the dipper arm effects digging or other work operations.

One measure of the performance characteristics of a backhoe relates to the maximum reach of the boom and dipper arm assembly, and in particular, the maximum working depth of the arrangement. As will be appreciated, versatility of use is enhanced by configuring a machine for a relatively great working depth. On balance, part of the versatility of a backhoe comes from its relatively compact and mobile nature, and thus increasing the working depth of the construction must not result in impairing or limiting the machine's mobility.

To this end, the present invention concerns an improved mounting arrangement for the backhoe boom and dipper arm assembly, whereby relatively greater working depths can be achieved, without limiting the mobility and versatility of the device.

SUMMARY OF THE INVENTION

The present invention concerns the provision of a bellcrank-like coupler construction between a swing tower and boom assembly of a backhoe. The invention further comprises the provision of first and second gear means respectively connected to the swing tower and boom, and preferably enclosed by the coupler. The first and second gear means are in operative meshing engagement with each other whereby operation of an associated boom actuator acts to raise and lower the pivoted end of the boom assembly adjacent the swing tower. In this manner, increased working depths can be achieved, without the overall height of the assembly being excessive when the backhoe is raised and in its transport position.

The present mounting arrangement comprises a pivotal swing tower, which is joined to a frame typically mounted on a loader or like material-handling implement for supporting the associated backhoe. The construction further includes a pivotal coupler pivotally joined to the swing tower for relative pivotal movement about a first horizontal axis. The boom of the backhoe is in turn pivotally joined to the coupler for relative pivotal movement about a second horizontal axis spaced from the first horizontal axis.

In order to provide the desired variable geometry of the mounting arrangement, a first gear or gear segment is joined to the swing tower and is fixed against rotation with respect thereto. In the preferred form, the gear has an effective pitch axis aligned with the first horizontal pivot axis of the coupler relative to the swing tower.

The mounting arrangement further includes a second gear or gear segment joined to the boom of the backhoe and fixed against rotation with respect thereto. The second gear is in operative meshing engagement with the first gear, and is preferably configured such that the effective pitch axis of the second gear is aligned with the second horizontal pivot axis of the boom relative to the coupler.

Pivotal vertical movement of the boom is effected by a selectively extensible hydraulic fluid actuator which extends between the coupler and the backhoe boom. By this arrangement, extension of the actuator causes the second gear to move about the first gear, thereby altering the vertical disposition of the second horizontal axis relative to the first horizontal axis relative to the first horizontal axis. By this action, the coupler pivots relative to the swing tower about the first horizontal axis, while the boom of the backhoe pivots relative to the coupler about the second horizontal axis.

In the preferred form, the second gear has an effective pitch diameter which is less than the first gear so that the coupler moves through a smaller angle than the backhoe boom attendant to operation of the boom actuator. By the present arrangement, the coupler adds to the digging depth of the overall assembly, thus permitting use of a relatively shorter boom without compromise of maximum working depth. At the same time, the overall height of the assembly is relatively reduced when the boom is in the fully raised position, thus contributing to convenient transport and mobility.

Other features and advantages of the present invention will become readily apparent from the following detailed description, the accompanying drawings, and the appended claims.

BRIEF DESCRIPTION OF THE DRAWING

FIG. 1 is a side elevational view of a material-handling implement comprising a tractor having a front-end loader, and a backhoe mounted on the rear thereof with a veriable geometry mounting arrangement embodying the principles of the present invention;

FIG. 2 is a fragmentary, side elevational view of a boom assembly and swing tower of the backhoe shown in FIG. 1, showing the boom in a raised, transport position;

FIG. 3 is a view similar to FIG. 2 illustrating the boom assembly in a relatively lowered position with respect to the associated swing tower;

FIG. 4 is a cross-sectional view taken along lines 4—4 of FIG. 3; and FIG. 5 is a cross-sectional view taken along lines 5—5 of FIG. 4.

DETAILED DESCRIPTION

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated a material-handling implemeht shown as a tractor 10 having a backhoe assembly 12 mounted on the rear thereof. In a typical arrangement, a front-end loader bucket assembly 14 is provided on the front of tractor 10, whereby the implement is capable of performing a wide variety of material-handling operations.

In accordance with the present invention, backhoe 12 includes a variable geometry mounting arrangement. To this end, the backhoe includes a swing tower 16 configured for horizontal swinging movement relative to an associated frame about a vertical axis A—A (FIGS. 2 and 3). Swinging movement is typically effected by a pair of hydraulic fluid swing actuators 18 (one shown) with the arc of travel of the backhoe assembly typically being on the order of 180 degrees.

The backhoe 12 further includes an elongated boom 20, which in accordance with the present invention may comprise a relatively simple and straightforward enclosed box section. Generally, a box section boom has a higher strength to weight ratio than other configurations, and exhibits desirable rigidity when subjected to torsional loads. While in a typical construction a backhoe boom is pivotally mounted directly to an associated swing tower, the present mounting arrangement includes a bellcrank coupler assembly 22 operatively disposed between the boom assembly and the swing tower. The features and construction of the coupler assembly are further discussed below.

Vertical pivotal movement of the boom assembly, and thus the overall backhoe, is effected by a selectively extensible hydraulic fluid boom actuator 24. Again in distinction from typical constructions, the boom actuator 24 extends between and is pivotally connected to the coupler 22 and the boom 20. It will be noted that the provision of the coupler assembly 22 permits the use of a single, centrally located boom actuator, as opposed to a pair of boom actuators positioned in generally flanking relation on opposite sides of the boom assembly. Not only does the use of a single boom actuator simplify the overall construction, but further promotes good operator visibility of the digging area, and positions the actuator for protection against damage.

A dipper arm 26 is pivotally connected to the boom 20, with a dipper actuator 28 operatively connected thereto for effecting pivotal movement of the dipper arm relative to the boom. A bucket 30 is in turn pivotally connected to the free end of the dipper arm, with a bucket actuator 32 provided for effecting pivotal movement of the bucket relative to the dipper. As will be recognized by those familiar with the art, coordinated operation of the boom actuator 24, the dipper actuator 28, and the bucket actuator 32 effects a curling-like motion of the backhoe assembly for digging and other material-handling operations.

In accordance with the present invention, a gearing arrangement is provided which operatively connects the swing tower 16 and the boom 20. To this end, a first gear 36 is joined to swing tower 16 in fixed relation with respect thereto, such as by a pair of splined pins 38 fixed to the swing tower 16 by mechanical fasteners or the like. As will be observed, first gear 36 is enclosed and journaled within the bellcrank coupler assembly 22. To this end, bushings 39 permit rotation of the coupler 22 relative to first gear 36 and pins 38.

The gearing arrangement further includes a second gear 40 joined in fixed relation to the backhoe boom 20 such as by a pair of splined pins 42 fixed to the boom. The second gear 40 is in operative meshing engagement with the first gear 36, and is held in such meshing engagement by its captive disposition within the coupler assembly 22. Bushings 43 permit relative rotation between the coupler 22 and second gear 40 and pins 42.

In the illustrated embodiment, first and second gears 36 and 40 are shown as conventional spur gears, a very wide variety of which are readily available on a commercial basis. As will be appreciated, the arrangement of the gears is such that attendant to extension of boom actuator 24, second gear 40 orbits about first gear 36, thereby effectively moving the vertical disposition of the pivotal anchor point of the boom 20. While it will be appreciated that the range of relative motion of the first and second gears is such that gear segments could alternately be employed, the use of gears having teeth about 360 degrees permits the gears to be routinely repositioned or indexed to employ different ones of their teeth for operation, thereby minimizing backlash attendant to tooth wear.

In the illustrated embodiment, the coupler assembly 22 is movable relative to swing tower 16 about a first horizontal axis, with the boom 20 movable relative to the coupler assembly about a second horizontal axis spaced from the first axis. In the preferred form, the first horizontal axis, illustrated as axis B—B in FIG. 4, corresponds to the effective pitch axis of the first gear 36. Similarly, the second horizontal axis, illustrated as axis C—C, is preferably aligned with the effective pitch axis of the second gear 40.

It is further preferred that the effective pitch diameter, D1, of second gear 40 be less than the effective pitch diameter D2 of first gear 36 (see FIG. 5). By this arrangement, the coupler assembly 22 moves through a relatively smaller angle, illustrated as angle "alpha" in FIG. 3, than the angle through which the boom moves, illustrated as angle "beta", attendant to extension of boom actuator 24.

As is best illustrated in FIGS. 2 and 3, it will be recognized that at full digging depth, the bellcrank coupler assembly 22 adds to the ultimate digging depth, thereby permitting use of a relatively shorter boom 20. Further, as the boom 20 is raised, the lower portion of the coupler 22 also raises, thereby desirably providing enhanced ground clearance. This arrangement also contributes to the "reach" of the assembly, and assures a good angle of departure.

As will be appreciated, the coupler assembly 22 is configured to retain the gears 36 and 40 in meshing engagement, and is configured to resist the torsional loads exerted on the assembly attendant to operation. In the preferred form, the coupler is configured to retain lubricant for the gears, with an access cover 44 and an oil fill port 45 facilitating assembly and maintenance.

Another desirable feature of the present invention relates to the anchoring of boom actuator 24 to coupler 22. The illustrated orientation desirably provides a relatively large moment arm through which the actuator 24 acts in the range of movement of the assembly in which digging is effected. The moment arm through which the actuator acts is particularly large at the maximum working depth, thus facilitating raising of the backhoe and loaded bucket from the bottom of an excavation.

Although the present construction desirably provides enhanced digging depth, it will be appreciated that the boom 20 can be of a relatively reduced length. Thus, when the backhoe is in its raised, transport position, the overall height is desirably reduced. A suitable latch 46 mounted on the coupler 22 facilitates securement of the backhoe assembly in its transport position.

While it will be recognized that the provision of the coupler assembly 22 and the gearing arrangement adds several components not found in a typical boom mounting arrangement, the distinct advantages provided by the arrangement are highly desirable. As noted, the manner in which the boom actuator is anchored on the coupler assembly 22 permits the actuator to work through a relatively larger moment arm than in an conventional construction; a single, relatively lighter duty actuator can thus be employed. As noted, the construction further permits the use of a relatively simple box-section enclosed boom. Additionally, a relatively lighter and less complex swing tower may be employed, with the preferred use of a single boom actuator (as opposed to use of a pair of actuators) simplifying the associated hydraulic fluid connections.

From the foregoing, it will be observed that numerous modifications and variations can be effected without departing from the true spirit and scope of the novel concept of the present invention. It is to be understood that no limitation with respect to the specific embodiment illustrated are intended or should be inferred. The disclosure is intended to cover all such modifications as fall within the scope of the appended claims.

What is claimed is:

1. An arrangement for mounting a hydraulically positionable backhoe having a boom on a material-handling implement, comprising:

swing tower means mounted on the material handling implement for supporting the backhoe;

pivotal coupler means pivotally joined to the swing tower means for relative pivotal movement about a first horizontal axis;

means pivotally coupling the boom of the backhoe to the coupler means for relative pivotal movement about a second horizontal axis spaced from the first horizontal axis;

first gear means joined to the swing tower means and fixed against rotation with respect thereto;

second gear means joined to the boom of the backhoe and fixed against rotation with respect thereto, said second gear means being in operative meshing engagement with the first gear means; and selectively extensible hydraulic fluid actuator means extending between said coupler means and the boom of said backhoe, whereby extension of the actuator means causes the second gear means to move about the first gear means to thereby alter the vertical disposition of the second horizontal axis relative to the first horizontal axis, and to thereby pivot the coupler means about the first horizontal axis while the boom of said backhoe pivots about the second horizontal axis.

2. The backhoe mounting arrangement in accordance with claim 1, wherein said pivotal coupler means is configured to generally enclose said first and second gear means.

3. The backhoe mounting arrangement in accordance with claim 1, wherein each of said first and second gear means defines a respective effective pitch diameter, the effective pitch diameter of said second gear means being less than the effective pitch diameter of said first gear means.

4. The backhoe mounting arrangement in accordance with claim 1, wherein each of said first and second gear means defines a respective effective pitch axis, wherein the effective pitch axis of said first gear means is aligned with said first horizontal axis, and the effective pitch axis of said second gear means is aligned with said second horizontal axis.

* * * * *